US005260240A

United States Patent [19]

Guthrie et al.

[11] Patent Number: 5,260,240

[45] Date of Patent: * Nov. 9, 1993

[54] PROCESS FOR THE DEMETALLIZATION OF FCC CATALYST

[75] Inventors: Charles F. Guthrie, El Sobrante; Lawrence W. Jossens, Albany; James V. Kennedy, Greenbrae; John A. Paraskos, San Rafael, all of Calif.

[73] Assignee: Chevron Research and Technology Company, San Francisco, Calif.

[ * ] Notice: The portion of the term of this patent subsequent to Mar. 26, 2008 has been disclaimed.

[21] Appl. No.: 803,925

[22] Filed: Dec. 9, 1991

Related U.S. Application Data

[63] Continuation-in-part of Ser. No. 741.844, Aug. 6, 1991, abandoned, which is a continuation of Ser. No. 590,538, Sep. 27, 1990, Pat. No. 5,071,807, which is a continuation of Ser. No. 459,097, Dec. 29, 1989, abandoned.

[51] Int. Cl.[5] ..... B01J 29/38; B01J 38/30; B01J 38/06; C10G 11/18

[52] U.S. Cl. ..... 502/41; 208/52 CT; 208/120; 502/21; 502/55; 502/516; 502/521

[58] Field of Search ..... 502/21, 41, 516, 521, 502/55; 208/52 CT, 120

[56] References Cited

U.S. PATENT DOCUMENTS

| | | | |
|---|---|---|---|
| 4,465,588 | 8/1984 | Occelli et al. | 208/120 |
| 4,707,461 | 11/1987 | Mitchell et al. | 208/120 |
| 4,784,752 | 11/1988 | Ramamoorthy et al. | 208/52 CT |
| 4,835,128 | 5/1989 | Child et al. | 502/21 |
| 4,944,865 | 7/1990 | Occelli et al. | 208/52 CT |
| 4,988,654 | 1/1991 | Kennedy et al. | 502/84 |
| 5,002,653 | 3/1991 | Kennedy et al. | 502/84 |
| 5,071,807 | 12/1991 | Kennedy et al. | 502/84 |

*Primary Examiner*—Paul E. Konopka
*Attorney, Agent, or Firm*—V. J. Cavalieri; W. K. Turner

[57] ABSTRACT

A process is disclosed for passivating the reactivity of contaminant metals, such as nickel and vanadium, which have been deposited on a catalytic cracking catalyst, by adding to the cracking catalyst a mixture of a calcium-containing material and a magnesium-containing material in a separate reactor in the presence of steam. The preferred calcium-containing material is dolomite and the preferred magnesium-containing material is sepiolite. It is also preferred to include antimony and/or bismuth compounds in the additive mixture.

18 Claims, No Drawings

PROCESS FOR THE DEMETALLIZATION OF FCC CATALYST

CROSS REFERENCES TO RELATED APPLICATIONS

This application is a continuation in part of application U.S. Ser. No. 741,844, filed Aug. 6, 1991 abandoned, which is a continuation of U.S. Ser. No. 590,538, filed Sep. 27, 1990 now U.S. Pat. No. 5,071,807, which is a continuation of U.S. Ser. No. 459,092, filed Dec. 29, 1989, now abandoned. Related applications are U.S. Ser. No. 459,094, filed Dec. 29, 1989, now U.S. Pat. No. 4,988,654; and U.S. Ser. No. 459,097, filed Dec. 29, 1989, now U.S. Pat. No. 5,002,653.

FIELD OF THE INVENTION

This invention relates to a process capable of removing vanadium from vanadium-contaminated FCC catalyst and passivating the nickel in a nickel-contaminated FCC catalyst in order to restore the activity and selectivity of the catalyst. Such FCC catalyst comprises catalytically active crystalline aluminosilicate zeolite.

BACKGROUND OF THE INVENTION

In ordinary catalytic cracking processes, various metallic contaminants which are present in hydrocarbonaceous feedstock, particularly vanadium, nickel, copper and iron, cause the degradation and/or deactivation of the catalytic cracking catalyst. Particularly susceptible to vanadium contamination are crystalline aluminosilicate zeolites, either natural or synthetic. This deactivation causes distillate yield loss, particularly through loss of active acid cracking sites, as well as metal poisoning via secondary dehydrogenation and coking reactions caused by the deposition of these heavy metals on the catalyst. Remedial technology has evolved in various ways to deal with this metals contaminant problem.

For example, one method uses metallic compound additives to the catalyst or the hydrocarbon oil which compound additives serve to passivate the metallic contaminants on the catalyst. U.S. Pat. No. 4,432,890, Beck et al., teaches a catalyst composition comprising a crystalline aluminosilicate zeolite dispersed in an amorphous inert solid matrix containing a metal additive. The metal additive may be introduced into the catalyst during the cracking process or during catalyst manufacture. Metal additives include water soluble inorganic metal salt and hydrocarbon soluble inorganic metal salts, and hydrocarbon soluble organometallics of selected metals. U.S. Pat. No. 3,977,963, Readal et al., teaches a method of negating the effects of metals-poisoning on a cracking catalyst by contacting the metal-contaminated catalyst with a bismuth or manganese compound. U.S. Pat. No. 4,101,417, Mitchell et al., would add 2000 ppm of tin to the catalyst for the same purpose. In U.S. Pat. No. 4,784,752, Ramamoorthy et al., disclose the addition of a passivating agent containing bismuth in a weight ratio of bismuth to "nickel equivalents" consisting of nickel, iron and vanadium. In U.S. Pat. No. 4,083,807, Mitchell et al., an improved cracking catalyst is obtained by incorporating into a crystalline aluminosilicate catalyst by ion exchange a substantial concentration of a metal selected from antimony, bismuth and manganese. U.S. Pat. No. 4,990,240, Pasek et al., teaches zeolite passivation of vanadium in terms of a passivation factor greater than 2.0 for selected Group IIA metal compounds. U.S. Pat. No. 4,929,583, Pasek et al., claims the catalyst composition comprising this vanadium passivator. U.S. Pat. No. 4,036,740, Readal et al., teaches a selected catalytic cracking process using a bismuth, antimony or manganese treating agent to maintain a selected volume ratio of carbon dioxide to carbon monoxide in the gaseous effluent. The disclosures of the aforementioned patents are incorporated herein as if fully set forth in ipsis verbis.

Another mechanism includes the use of various diluents as metals passivators or traps. The traps contain materials which will chemically combine with and effectively tie up the offending materials. These traps have proved particularly effective with regard to vanadium.

One strategy utilizing this mechanism involves the use of dual particle systems wherein the cracking catalyst, usually zeolitic, is contained on one particle or component of the system, and a diluent or vanadium trap is contained as a separate, distinct entity on a second particle or component of the system. U.S. Pat. No. 4,465,588, Occelli et al., discloses a process for cracking high metals content feedstock using a novel catalyst cracking composition comprising a solid cracking catalyst and a separate and distinct diluent which contains materials selected from magnesium compounds, or a selected magnesium compound in combination with one or more heat-stable metal compounds. Among the magnesium-containing compounds specified is magnesium clay sepiolite. U.S. Pat. No. 4,465,779 teaches the cracking catalyst of '558 itself. U.S. Pat. No. 4,615,996, Occelli, teaches a dual-function cracking catalyst composition comprising a solid cracking catalyst and a separate, distinct particle diluent containing substantially catalytically inactive crystalline aluminosilicate. U.S. Pat. No. 4,466,884, Occelli et al., teaches a process wherein the separate and distinct entity diluent contains antimony and/or tin, supported on an inert base selected from the group consisting of magnesium-containing clay minerals, including sepiolite. U.S. Pat. No. 4,650,564, Occelli et al., also teaches a process for cracking high metals content feedstock comprising contacting the feed with a dual particle catalyst cracking composition comprising a solid cracking catalyst and, as a separate and distinct entity, an alumina diluent. U.S. Pat. No. 4,944,865, Occelli et al., also teaches a dual particle catalytic cracking system comprising a cracking catalyst and a second component comprising magnesium oxide. U.S. Pat. No. 4,707,461, Mitchell et al., discloses a catalyst composition comprising zeolite, matrix, and a calcium-containing additive comprising substantially amorphous calcium silicate as a separate and discrete component. A preferred calcium additive component comprises dolomite.

One primary issue involving the use of the dual particle systems in fluid catalytic cracking is that the effect of the diluent particle on yield is such that the activity of the active catalyst must be very high in order to compensate for the dilution effect. It would therefore be helpful to develop a dual particle catalyst wherein the diluent could be added in low amounts and have enhanced metals scavenging ability, in particular vanadium. Secondarily, it would be advantageous for the catalyst system to demonstrate higher sulfur tolerance than previous known systems, as some feeds requiring processing have high enough sulfur levels to cause process difficulties with known catalysts.

Related patent U.S. Pat. No. 4,988,654, Kennedy and Jossens, claims such a dual component catalyst composition for the catalytic cracking of metal-containing hydrocarbonaceous feedstock comprising as a first component an active cracking catalyst; and as second component, a separate and distinct particle comprising a selected calcium and magnesium containing material; a magnesium containing material comprising a hydrous magnesium silicate; and a selected binder. U.S. Pat. No. 5,002,653, Kennedy and Jossens, claims the catalytic cracking process with the dual component catalyst of '654. Related patent application U.S. Ser. No. 590,538, filed Sep. 27, 1990, claims the second component of the dual component catalyst system. The disclosure of U.S. Ser. No. 590,538 is incorporated herein by reference. The preferred second component comprises dolomite and sepiolite. U.S. Pat. No. 4,196,102, Inooka et al., relates to a hydrotreating catalyst comprising selected catalytic metals on a sepiolite carrier. U.S. Pat. No. 4,343,723, Rogers et al., teaches the use of clays with crystalline aluminosilicate zeolite in catalytic compositions. U.S. Pat. No. 4,439,312, Asaoko et al., provides a catalyst for hydrotreating heavy oil, including a carrier which is a calcined mixture of selected magnesium silicate and selected pseudoboehmite. U.S. Pat. No. 4,929,338, Wormsbecker, reports a catalytic cracking catalyst for vanadium-containing hydrocarbons having a selected dolomite component mixed with a zeolite cracking catalyst as an integral component or as a separate additive. The disclosure of the aforementioned patents are incorporated herein as if fully set forth in ipsis verbis.

To carry this strategy one step further, it would be advantageous if, for example, a dolomite/sepiolite particle additive when added to an FCC catalyst inventory contaminated with vanadium, either in situ. in the FCC unit, or by treatment of the contaminated catalyst ex situ, would take up vanadium from the catalyst. It would also be advantageous if a metallic passivator, as heretofore described, were incorporated into the additive to render nickel contaminants inert in place on the catalyst. It would be especially advantageous if after such treatment with the additive, the catalyst would regain its activity without removal of the additive from the catalyst inventory. However, it would suffice if re-activated catalyst were separable from the additive, separated and reused.

This strategy, if successful, would result in a rejuvenated catalyst having the following benefits: Revived catalyst activity offering higher FCC conversion or feed throughput; Removal of pore blocking vanadium; Reduced fresh catalyst consumption; The opportunity for accommodating heavier oil feedstocks, or residuum.

SUMMARY OF THE INVENTION

The present invention is a process for the removal of contaminant metals from contaminated catalytic cracking catalyst. The process is particularly effective for the removal of vanadium from cracking catalyst. It can also accommodate the passivation of active nickel on the surface of the catalyst. The process comprises the step of contacting the contaminated particulate catalyst with a selected additive material in a separate distinct particle. The selected additive material comprises a calcium-containing material in combination with a magnesium-containing material, wherein the calcium-containing compound is active for metals trapping, especially vanadium trapping. The preferred calcium-containing material is dolomite and the preferred magnesium-containing material is sepiolite. In an embodiment of the invention, the selected additive material contains antimony, bismuth, or an antimony, bismuth compound on the separate distinct particle. Upon contacting with contaminated particulate catalyst under fluidized catalytic cracking conditions, and in particular under regenerative fluidized catalytic cracking conditions which generally comprise oxidizing high temperature conditions, one of the contaminants, vanadium, is found to transfer to the additive particles, where it is effectively rendered inert. In a final step, the additive particles may be separated from the catalyst particles. The use of antimony or bismuth in the process offers the additional advantage of passivating metal contaminants such as nickel which are not transferred from the contaminated catalyst to the additive particles; rather the antimony or bismuth species can transfer to the immobilized nickel contaminant to negate its dehydrogenation activity.

DETAILED DESCRIPTION OF THE INVENTION

FCC Catalyst

The fluid catalytic cracking catalyst can be any cracking catalyst of any desired type having high activity. By "high activity" we mean catalyst of fresh MAT Activity above about 1.0, preferably up to about 4.0, or even higher, where $$\text{Activity} = \frac{\text{wt \% Conversion}}{100 - \text{wt \% Conversion}}$$

The "MAT Activity" was obtained by the use of a microtest (MAT) unit similar to the standard Davison MAT (see Ciapetta et al., Oil & Gas Journal, 65,88 (1967), or as defined in ASTM standard test No. D 3907-87.

Preferably, the host catalyst used herein is a catalyst containing a crystalline aluminosilicate, preferably exchanged with rare earth metal cations, sometimes referred to as "rare earth-exchanged crystalline aluminum silicate" or one of the stabilized hydrogen zeolites. Typical zeolites or molecular sieves having cracking activity which can be used herein as a catalytic cracking catalyst are well known in the art. Suitable zeolites are described, for example, in U.S. Pat. No. 3,660,274 to Blazek et al., or in U.S. Pat. No. 3,647,718 to Hayden et al., or in U.S. Pat. No. 4,493,902 to Brown et al., which are incorporated herein by reference. Synthetically prepared zeolites are initially in the form of alkali metal aluminosilicates. The alkali metal ions are typically exchanged with rare earth metal and/or ammonium ions to impart cracking characteristics to the zeolites. The zeolites are crystalline, three-dimensional, stable structures containing a large number of uniform openings or cavities interconnected by smaller, relatively uniform holes or channels. The effective pore size of synthetic zeolites is suitably between 6 and 15 Å in diameter. The overall formula for the preferred zeolites can be represented as follows:

$$H_{(2-x)}\cdot XM_{2/n}O:Al_2O_3:1.5\text{–}6.5\ SiO_2:yH_2O$$

where M is a metal cation and n its valence and x varies from 0 to 1 and y is a function of the degree of dehydration and varies from 0 to 9. M is preferably a rare earth metal cation such as lanthanum, cerium, praseodymium, neodymium or mixtures of these.

Zeolites which can be employed herein include both natural and synthetic zeolites. These zeolites include gmelinite, chabazite, dachiardite, clinoptilolite, faujasite, beta, heulandite, analcite, levynite, erionite, sodalite, cancrinite, nepheline, lazurite, scolecite, natrolite, offretite, mesolite, mordenite, brewsterite, ferrierite, and the like. The faujasites are preferred. Suitably synthetic zeolites which can be treated in accordance with this invention include zeolites X, Y, including chemically or hydrothermally dealuminated high silica-alumina Y, A, L, ZK-4, beta, ZSM-types or pentasil, boralite and omega, SZ-26 and SZ-33. The term "zeolites" as used herein contemplates not only aluminosilicates but substances in which the aluminum is replaced by gallium or boron and substances in which the silicon is replaced by germanium. The preferred zeolites for this invention are the synthetic faujasites of the types Y and X or mixtures thereof.

To obtain good cracking activity the zeolites have to be in a proper form. In most cases this involves reducing the alkali metal content of the zeolite to as low a level as possible. Further, a high alkali metal content reduces the thermal structural stability, and the effective lifetime of the catalyst will be impaired as a consequence thereof. Procedures for removing alkali metals and putting the zeolite in the proper form are well known in the art, for example, as described in U.S. Pat. No. 3,537,816.

The crystalline aluminosilicate zeolites, such as synthetic faujasite, will, under normal conditions, crystallize as regularly shaped, discrete particles of approximately 1 to 10 microns in size, and, accordingly, this is the size range normally used in commercial catalysts. The particle size of the zeolites can be, for example, from about 0.1 to about 10 microns, but generally from about 1 to about 5 microns or less. Crystalline zeolites exhibit both an interior and an exterior surface area, with the largest portion of the total surface area being internal. Blockage of the internal channels by, for example, coke formation and contamination by metals poisoning will greatly reduce the total accessible surface area, and, thereby, the efficiency of the catalyst. The crystalline alkali metal aluminosilicate can, therefore, by preferably cation-exchanged by treatment with a solution essentially characterized by a pH in excess of about 4.5, preferable by a pH in excess of 5, and containing an ion capable of replacing the alkali metal and activating the catalyst, excepting in the case of rare earth cations where the pH should be less than 5.0 but greater than 4.0. The alkali metal content of the finished catalyst should be less than about 1 and preferably less than about 0.5 percent by weight. The cation-exchange solution can be contacted with the crystalline aluminosilicate of uniform pore structure in the form of a fine powder, a compressed pellet, extruded pellet, spheroidal bead or other suitable particle shapes. Desirably, the zeolite comprises from about 3 to about 60, preferably from about 10 to about 40, and more preferably from about 20 to about 40 wt % of the total catalyst inventory.

The zeolite is preferably incorporated into a matrix. Suitable matrix materials include the naturally occurring clays, such as kaolin, halloysite, sepiolite, saponite, montmorillonite, pillared or cross-linked clays, and inorganic oxide gels comprising amorphous catalytic inorganic oxides such as silica, silica-alumina, silica-zirconia, silica-magnesia, alumina-boria, alumina-titania, and the like, and mixtures thereof. Preferably the inorganic oxide gel is a silica-containing gel, more preferably the inorganic oxide gel is an amorphous silica-alumina component, such as a conventional silica-alumina cracking catalyst, several types and compositions of which are commercially available. These materials are generally prepared as a co-gel of silicon and alumina, co-precipitated silica-alumina, or as alumina precipitated on a pre-formed and pre-aged hydrogel. In general, silica is present as the major component in the catalytic solids present in such gels, being present in amounts ranging between about 55 and 100 wt. %. The matrix component may suitably be present in the catalyst of the present invention in an amount ranging from about 40 to about 92 wt. %, preferably from about 60 to about 80 wt %, based on the total catalyst.

Especially preferred as the catalytically active component of the catalyst system claimed herein is a crystalline aluminosilicate, such as defined above, dispersed in a refractory metal oxide matrix, for example, as set forth in U.S. Pat. No. 3,944,482 to Mitchell et al., referred to above.

The matrix material in the host catalyst can be any wellknown heat-stable or refractory metal compounds, for example, metal oxides, such as silica, alumina, magnesia, boron, zirconia, or mixtures of these materials or suitable large pore clays, acid activated clays, pillared or crosslinked clays or mixed oxide combinations.

The particular method of forming the catalyst matrix does not form a part of this invention. Any method which produces the desired cracking activity characteristics can suitably be employed. Large pored refractory metal oxide materials suitable for use as a matrix can be obtained as articles of commerce from catalyst manufacturers or they can be prepared in ways well known in the art such as described, for example, in U.S. Pat. No. 2,890,162, the specification of which is incorporated herein by reference.

The method of forming the final composited catalyst also forms no part of this invention, and any method well known to those skilled in this art is acceptable. For example, finely divided zeolite can be admixed with the finely divided matrix material, and the mixture spray dried to form the final catalyst. Other suitable methods are described in U.S. Pat. Nos. 3,271,418; 3,717,587; 3,657,154; and 3,676,330; whose descriptions are incorporated herein by reference. The zeolite can also be grown in the matrix material if desired, as defined, for example in U.S. Pat. No. 3,657,718 to Hayden et al., or U.S. Pat. No. 4,493,902 to Brown et al., referred to above.

In combination with the latter "in-situ" zeolite particles, a catalytically inert porous material may also be present in the finished catalyst. The term "catalytically inert" refers to a porous material having substantially no catalytic activity or less catalytic activity than the inorganic gel component or the clay component of the catalyst. The inert porous component can be an absorptive bulk material which has been pre-formed and placed in a physical form such that its surface area and pore structure are stabilized. When added to an impure inorganic gel containing considerable amounts of residual soluble salts, the salts will not alter the surface pore characteristics measurably, nor will they promote chemical attack on the pre-formed porous inert material. Suitable inert porous materials for use in the catalyst of the present invention include alumina, kaolin, halloysite, titania, silica, zirconia, magnesia, and mixtures thereof. The porous inert material, when used as a component of the catalyst of the present invention, is present in the finished catalyst in the amount ranging from about 10 to about 60 wt % based on the total catalyst.

The Additive

The additive defined herein is a separate and distinct particulate entity from the catalyst, and comprises two different components. The additive is preferably held together by a binder to impart structural integrity. These components each bring their own characteristics and qualities to the invention, and interact synergistically to yield an additive of unique properties.

The first component comprises a magnesium-containing material, preferably a hydrous magnesium silicate, which may act as a matrix for the diluent, providing the medium for the active component to disperse within the additive itself. The preferred magnesium-containing compounds comprise hydrous magnesium silicate, more preferably sepiolite, (most preferably Spanish sepiolite), attapulgite, palygorskite, saponite, talc, and Celkate T-21 ®, a synthetic amorphous magnesium silicate. It is preferred that the magnesium compound be in crystalline form, and low in both iron, potassium and sodium.

The second component comprises a calcium-containing material, in particular a calcium and magnesium containing material, which, under conditions found in catalytic cracking processes, in combination with the first, transforms into active components which may consist of, but are not limited to periclase, and such calcium-magnesium silicates as merwinite, akermanite and to a lesser extent diopside. This second component is the active component of the additive and particularly provides the necessary vanadium trapping activity appropriate to the effectiveness of the present invention.

The preferred calcium-containing materials comprise dolomite, calcium-magnesium silicate, calcium-magnesium oxide, calcium-magnesium acetate, and calcium-magnesium carbonate or subcarbonate. The most preferred material is dolomite. It is preferred that the calcium-containing materials be fine ground to a particle size of about 3 microns or less in order to improve particle integrity, thereby increasing attrition resistance and to improve sulfur tolerance.

The combination of the calcium-containing material and the magnesium-containing material and, in particular, the combination of dolomite and sepiolite, provides an additive with a high calcium-magnesium composition, which is particularly effective for vanadium trapping and which is at the same time attrition resistant and not so friable as to create process difficulties in catalytic cracking units. Moreover, the minerals involved, in particular dolomite, are relatively inexpensive, particularly relative to the zeolite component of the catalyst generally, thereby providing an economic advantage in view of the vanadium trapping efficiency of the additive.

The ratio of the two components one to the other is also a factor in the effectiveness of the additive. It is preferred that the calcium-containing material and the magnesium-containing material be present in a weight ratio of from about 20:80 to about 80:20 calcium-containing material to magnesium-containing material. More preferably, the ratio is from about 50:50 to about 70:30.

It is preferred that the additive contain antimony or bismuth metallic passivators as heretofore described, e.g., U.S. Pat. No. 4,784,752, to assist the restoration of catalyst activity. It is preferred that the level of bismuth or antimony range from 0.05:1 to 1:1 atom to atom ratio of introduced passivator to nickel contaminant on the catalyst.

While the specific mechanism by which the additive traps contaminants is not claimed as part of the present invention, one possible mechanism is suggested as follows. When fresh hydrocarbon feed contacts catalyst in the cracking zone, cracking and cooking reactions occur. At the same time, vanadium and nickel are quantitatively deposited on the surface of the catalyst. At this point the contaminant metals function by quite different mechanisms. Spent catalyst containing the metal deposits passes from the cracking unit to the regenerator where temperatures normally in the range of 1150°-1400° F. (621°-760° C.) are encountered in an oxygen/steam-containing environment. Conditions are therefore suitable for vanadium migration to and reaction with the active zeolitic component of the catalyst. The reaction results in formation of mixed metal oxides containing vanadium which causes irreversible structural collapse of the crystalline zeolite. Upon degradation, active sites are destroyed and catalytic activity declines. Activity can be maintained only by adding large quantities of fresh catalyst at great expense to the refiner.

It is theorized that addition of the additive of the present invention prevents the vanadium interaction with the zeolite by acting as a trap or sink for vanadium. Under regenerating conditions, vanadium present on the catalyst particles preferentially migrates to and reacts with the calcium/magnesium-containing additive. Competitive reactions are occurring and the key for successful vanadium transfer is to utilize an additive with a significantly greater rate of reaction toward vanadium than that displayed by the zeolite. As a result, the vanadium is deprived of its mobility, and the zeolite is protected from attack and subsequent collapse. It is believed that vanadium and the calcium/magnesium additive forms one or more new binary oxides.

In contrast to vanadium which is mobile, contaminant nickel is a relatively stationary phase, and poisons the catalyst in a different manner. Under the reducing environment of reactor conditions at typical temperatures of 900° to 1050° F., nickel becomes an active dehydrogenation agent, forming excess coke and hydrogen at the expense of desirable gasoline yield. Activity of nickel for this competitive side reaction is dependent upon its degree of dispersion, which in turn is related to the surface area and porosity of the catalyst matrix. The effect of nickel can decay via the formation of large crystallites on the surface (agglomeration), formation of inert species with the matrix (spinels or silicates) or through the use of added passivators such as bismuth or antimony.

It is postulated that the additive of the current invention deactivates the active nickel species by providing a reservoir of passivating bismuth or antimony. Under cracking conditions, a small but finite amount of passivator will proceed by a particle transfer mechanism to migrate to the offending nickel which it subsequently neutralizes by coating, alloying, or promoting agglomeration.

The catalyst particle size must render it capable of fluidization as a disperse phase in the reactor. Typical and non-limiting fluid catalyst particle size characteristics are as follows:

| Size (Microns) | 0–20 | 20–45 | 45–75 | >75 |
|---|---|---|---|---|
| wt. % | 0–5 | 10–15 | 45–65 | 20–40 |

These particle sizes are usual and are not peculiar to this invention. The additive particle size is selected to assist physical separation from the catalyst without substantial loss of catalyst by, for example, selecting an additive particle size distribution centered around 20 microns or smaller, or conversely greater than 150 microns.

Binder

It is also preferred to include a separate binder which binds together the subcomponents of the additive. The binder provides additional strength and attrition resistance, as well as surface area and dispersion known to capture vanadium or other metals, i.e., large porosity. The preferred embodiment of the present invention would include from 5 to 30% by weight of an inorganic binder. The binder is used to impart density and strength and maintain particle integrity of the second component as is used in combination with the other components of the additive particle. The inorganic binder can be those conventionally employed by those skilled in the art, including but not limited to clays such as kaolin, bentonite (montmorillonite), saponite and hectorite, pillared or cross-linked clays, or precipitated synthetic binders such as alumina, zirconia, titania, silica, silica-alumina, or derived from such standard commercially available materials as Catapal®, Chlorohydrol®, or SMM®, or combinations thereof. For application in high sulfur feeds, a preferred binder would be a sulfur trapping material such as alumina which might be obtained through the polymerization of Chlorohydrol® or peptized pseudo-boehmite alumina.

A preferred method of preparing the additive is by spray-drying a slurried mixture of the components of the additive, including the binder. The slurried mixture may be prepared by, for example, adding the calcium-containing material and the magnesium-containing material to a silica sol, to peptized alumina, or to a mixture thereof. Peptized alumina may also be added to the slurried mixture after the other components of the additive are blended together. In the preferred embodiment, the concentrations of the components in the additive can range from a ratio by weight of 20%:80% to 80%:20% dolomite:sepiolite, with the binder comprising between about 5% to 20% by weight. The most preferred composition comprises 50% dolomite, 40% sepiolite and 10% binder.

Demetallization of FCC Catalyst

In the process of this invention, one begins with an FCC catalyst contaminated with metals, in particular, metals selected from the group consisting of vanadium, nickel and iron which deactivate the cracking catalyst. Contamination occurs in the course of FCC processing of heavy hydrocarbonaceous oils of high metals content. The extent of such metals contamination, expressed in terms of vanadium on the catalyst at equilibrium may range from about 2,000 to 10,000 ppm by weight or more, often between about 3,000 to 5,000 ppm, based on the weight of the catalyst. Expressed in terms of nickel equivalents where, $$\text{Ni equivalent} = \text{Ni} + \text{V}/5 + \text{Cu}/10 + \text{Fe}/10,$$

equilibrium metals may range from 1500 ppm to 10,000 ppm, and more often between 2,000 to 4,000 ppm, based on weight of catalyst.

The vanadium content of the catalyst is reduced by contacting the catalyst with the additive of this invention under FCC process conditions, particularly, under the regenerating conditions of an FCC process. Such regenerating conditions comprise, generally, an oxidative atmosphere at high temperature. The temperature normally ranges from about 1150° F. to 1500° F., preferably from 1250° F. to 1400° F. FCC process regenerating conditions also comprise steaming of the catalyst in the presence or in the substantial absence of oxygen. Steam normally comprises 10 to 20% of the partial pressure of the FCC regenerators. If the metal contaminated catalyst is downloaded from the FCC regenerator, it can be rejuvenated by employing an external reactor at temperatures from 1200° to 1400° F. at steam partial pressures ranging from 10 to 95% of the total reactor pressure to enhance the mobility of the vanadium.

The regenerating conditions comprise not only the normal FCC regeneration zone, but a separate fluidized bed under regenerating conditions may be used with the additive of this invention to demetallize FCC catalyst taken from the FCC unit via a slipstream. Alternatively, an ebullated bed reactor may be used.

Preferably, the additive contains an antimony or bismuth compound, preferably antimony oxide or bismuth oxide, most preferably bismuth oxide. These compounds serve to passivate the metals on the FCC catalyst under cracking conditions, particularly, nickel, rendering a catalyst of increased gasoline selectivity, with reduced dehydrogenation and coking tendencies.

After demetallization and/or passivation, the FCC catalyst may be optionally separated from the additive. Any means of separation known to the art may be used, but since both the FCC catalyst and the additive are particulate, separation by particle size differentiation is effective. Any means of particle size differentiation may be used, such as screening with appropriate mesh sizes. Alternatively, magnetic separation may be used. In particular, high intensity magnetic separation may be employed. To enhance the separation, it is suggested that a magnetic reactive component, for example iron oxide, be incorporated in the additive.

In the preferred use of the present invention, the additive is added to the catalyst inventory of an FCC process unit in an amount of from about 1 to 20% by weight of catalyst. The additive circulates with the FCC catalyst under FCC process conditions and serves as an in situ means of demetallizing the catalyst.

In an alternative mode of operation, spent downloaded catalyst can be charged to an external reactor containing 10–40% of additive. Reaction conditions should be 1200° to 1400° F., 10–95% steam, 1–3% excess air.

EXAMPLES

Additive A

Preparation of Dolomite/Sepiolite Additive

A calcium/magnesium-containing material useful for this invention was prepared using an aluminum hydroxy oligomer as the binding agent. 80 g of a 50 wt % aqueous solution of aluminum chlor-hydroxy (Reheis Chemical) was dispersed in 500 ml of deionized water. To this was added 160 g (dry basis) of crushed Spanish sepiolite (Tolsa) with high shear, followed by 200 g crushed dolomite again with high shear. The mixture thickened and was diluted back to about 36% solids by the addition of 150 ml of additional water, and allowed to stir for two hours at ambient conditions. The resultant slurry was then converted to microspheroidal form using a laboratory sized spray-drier (Yamato). The powder was dried at 250° F. in a vacuum oven, and then reslurried in one liter of 20% ammonium hydroxide solution for 15 minutes at 80 C. The slurry was filtered and the process repeated. Resultant filter cake was further water washed and dried at 250° F., and subsequently calcined at 1000° F. the material was lightly crushed to break additives and sieved to 100/325 mesh and designated Additive A. A similar formulation was prepared in larger quantities using a Bowen pilot-plant sized spray-drier and designated Additive A'. These additives were comprised of 50% dolomite, 40% sepiolite and 10% binder, and on an oxide basis contained about 29 wt % calcium, 29 wt % magnesium, and 32 wt % silicon.

Additive B

Alternative Preparation of Dolomite/Sepiolite Additive

Another version of the calcium magnesium-containing material of the current invention was prepared using a higher level of a different precipitated silica-alumina binder. The specific formulation was 80 wt % active components (50:40 parts by weight dolomite:sepiolite) and 20 wt % binder (36:64 parts by weight of alumina:silica). On a 100 lb. dry basis, the formulation can be computed as using 44.4 lb. dolomite, 35.6 lb. sepiolite, 12.8 lb. silica, 7.2 lb. alumina and 1.45 lb. 90% formic acid.

The active components — dolomite and sepiolite — were dispersed into a silica-alumina gel prepared by first peptizing a 12 wt % solids alumina (CATAPAL) slurry with 90% formic acid at a 0.2 lb. acid/lb. alumina ratio, which was then added to a 40 wt % solids silica sol (Nalco 1027). To ensure both good particle attrition resistance and sulfur tolerance, finely ground, micronized dolomite and sepiolite clays were used. The dolomite (National Mineral Products, Grade D-307) was further comminuted to less than 3 microns average particle size by wet milling at about 35 wt % solids. The sepiolite (Tolsa, MICRO 65) was used as received. The order of addition was to add the micronized dolomite slurry to the binder slurry, followed by dry addition of the powdered sepiolite. High shear stirring was avoided to minimize gel formation. The system employed sufficient process water to produce a final make-down slurry of 28 wt % solids. The additive slurry was spray-dried to a coarser average particle size (>90 microns) to help provide better retention in circulating fluidized beds.

CATALYSTS

A number of catalyst systems containing the additive used in the claimed process are described to demonstrate utility for vanadium passivation. The catalyst inventory of each test catalyst system (except for reference catalysts) contained a mixture of commercial catalyst particles, along with discrete, vanadium passivator particles.

CATALYST 1

Reference Catalyst 1 was a low metals, equilibrium version of OCTACAT "+", a commercial FCC catalyst manufactured by Davison Chemicals. It was calcined for 3 hours at 1300° F. to burn off contaminate coke.

CATALYST 2

Catalyst 2 is physical blend of 80 wt % OCTACAT "+" calcined equilibrium (i.e., Catalyst 1) and 20 wt % Additive B. Additive B in this instance was calcined at 1500° F. for three hours and sieved to 100/300 mesh.

CATALYST 3

Catalyst 3 is Catalyst 1 which had been contaminated with a nominal 6000 ppm vanadium by circulating in a large 0.5 bbl/day pilot-plant with a vanadium naphthanate feedstock.

CATALYST 4

An admixture was prepared using 80 wt % Catalyst 1 with 20 wt % of Additive A'. The blend was subsequently contaminated with a nominal 6000 ppm vanadium loading in a manner analogous to Catalyst 3.

CATALYST 5

A blend of 90 wt % Catalyst 3 and 10% Additive A'.

CATALYST 6

A blend of 90 wt % Catalyst 4 and 10% Additive A'.

Portions of Catalysts 1, 3, 4, 5, and 6 were each subjected to steam deactivation in a fluidized bed steaming unit at 1350° F., and 20% steam at time intervals of 0, 48 and 72 hours, respectively. Catalysts so treated are identified with the suffix A, B, or C for 0, 48 or 72 hrs, respectively. Catalyst 6 which was steamed for 72 hour is designated as catalyst 6C.

CATALYST 7

Catalyst 7 was formulated by diluting a very high USY zeolite containing microspheroidal material stabilized with 1 wt % rare earths, to a net 34% USY. The diluent was an inert material having little catalytic or passivation activity. Both the zeolite concentrate and diluent materials were steam deactivated for 5 hours at 1475° F., in a fixed-fluidized bed steamer, prior to blending.

CATALYST 8

A catalyst similar to Catalyst 7 was formulated to include 20 wt % of Additive B which had been steam deactivated for the equivalent of ½ hour at 1500° F. and 50% steam. Additive B substituted for a portion of the diluent used in Catalyst 7. Net zeolite content of the catalyst was also 34%.

EXAMPLE 1

Selective Scavenging of Aged Vanadium

A portion of Catalyst 2, a composite of calcined equilibrium catalyst and 20% calcined Additive B of this invention, was steam-aged for 5 hours at 1350° F. in a flowing stream of 95% steam and 5% nitrogen. Both the steamed and unsteamed catalyst blends were then examined by Scanning Electron Microprobe techniques to determine vanadium concentrations on individual catalyst or additive particles. The results are listed in Table I, and are, reported as a ratio of the vanadium found on the steamed particles to the vanadium on the original unsteamed particles. The data indicate that the average majority host OCTACAT particle lost about 80 ppm vanadium when steamed in the presence of the vanadium trap, while the trap picked up typically about 350 ppm per particle, nearly 10 times its original level. The net gain in vanadium content by all particles of Additive B is computed to be 90% of the observed loss for the host equilibrium catalyst, reasonably good agreement given the low level of contamination and accuracy of the test method. Thus it can be seen that under the steaming conditions described, Additive B was able to selectively scavenge vanadium from the host FCC catalyst.

EXAMPLE 2

The beneficial effect of the additive of this invention in the presence of high vanadium contamination is demonstrated in Table III. Catalyst 3, the unprotected host FCC equilibrium material, and Catalyst 4 containing 20% of Additive A', were each loaded to a nominal 6000 ppm in a circulating fluid bed pilot-plant using a vanadium doped feed. They are contrasted with Catalyst 1, the vanadium free catalyst. A portion of each of the catalysts was aged at simulated regeneration conditions under which vanadium is known to migrate (1350° F., 20% steam for 72 hours). Each of the catalysts was subsequently tested in a MAT test at 960° F., 15 weight hourly space velocity (WHSV), 75 seconds contact time, and a catalyst to oil ratio (C/O) of 3.4 with 3.5 grams of catalyst. The charge stock was a gas-oil having a boiling range as characterized in Table II below.

The poisoning effect of vanadium on the unprotected catalysts can be seen by comparing catalysts 1 and 3 at equivalent steaming times. Conversion and gasoline yield are lost due to degradation of the active zeolite component. Increased hydrogen make due to vanadium's ability to function as a dehydrogenation agent is also evident. The positive impact of having the vanadium scavenger present is seen by comparing catalyst 4 with catalyst 3. Much of the fresh conversion and gasoline yield is preserved and there is less of an effect of steaming. Likewise the dehydrogenation activity is diminished.

EXAMPLE 3

Having demonstrated that the synergistic dolomite/-sepiolite combination provides passivation in the presence of freshly added vanadium, it remains now to be shown that the addition of fresh additive will remove previously deposited vanadium from an equilibrium catalyst. Evidence for this is tabulated in TABLE IV. Catalyst 5 is Catalyst 3 having a nominal value of 6000 ppm vanadium-on-cat, to which has been added 10% fresh Additive A'. A portion of each catalyst was then further steamed for 48 or 72 hours.

MAT evaluations show the dilution effect of adding the catalytically inert additive in the absence of further ageing. With additional steaming it can be seen Catalyst 5 retains more of its initial conversion and gasoline yield than does Catalyst 3. Likewise, Catalyst 5 has reduced hydrogen and coke make as compared to Catalyst 3, indicating vanadium passivation. The vanadium trapping ratio (vanadium on additive particle relative to vanadium on FCC catalyst particle) for Catalyst 5, as determined by electron microprobe inspections of the spent catalyst, is also consistent with the data. Steaming is the driving force that provides mobility for deposited vanadium at regenerator temperatures. As steaming time increases the vanadium trapping ratio is climbing, indicating selective scavenging and retention of vanadium by Additive A''. Thus, this data confirms the effect observed in Example 1, namely that the additive can cleanse an equilibrium catalyst of aged vanadium.

EXAMPLE 4

Additional evidence of the ability of Additive A' to passivate FCC catalysts by extracting aged vanadium is depicted in Table V. In this instance 10% of fresh Additive A' has been added to Catalyst 4 which already contains a blend of 20% additive and has been contaminated with 6000 ppm vanadium. As steaming time progresses, both catalysts are exhibiting vanadium passivation, but at the end of 72 hours, Catalyst 6C which contains 50% more additive (hence more activity dilution) is providing comparable conversion and reduced hydrogen and coke selectivity. Moreover, the vanadium trapping ratio has been growing consistently. After 72 hours, each additive particle contains nearly 18 times the vanadium loading as the host FCC particle. The nearly threefold increase in trapping ratio over the previous example is attributed to a threefold increase in additive content, and also indicates that both fresh and aged additive are continuing to provide passivation.

EXAMPLE 5

The additive of this invention was tested for its ability to passivate vanadium in the presence of high levels of nickel. Catalysts 7 (Reference) and 8 (with additive) were formulated to the same net zeolite content using rare earth stabilized USY from previously steam deactivated materials. Each was subsequently contaminated with approximately 3000 ppm nickel equivalents (Nickel Equivalent = Ni, ppm + V/5, ppm) by cracking in a fixed-fluidized bed cyclic (FFBC) reactor using a feedstock doped with nickel and vanadium naphthanates. This testing methodology is designed to mimic pilot-plant and commercial FCC operating conditions. It permits the catalyst inventory to be exposed to a repetitive cyclic environment consisting of cracking, steam stripping, and regeneration.

Two different sets of ageing conditions were employed, viz:

* C1: Ageing occurred over 70 cycles, with cracking at 16 WHSV and 1030° F., steam stripping at 970° F., and regeneration at 1400° F. in the presence of 50% steam. This set of conditions is known to produce a catalyst having a metals distribution profile resembling a true commercial equilibrium catalyst.
* C2: An accelerated sequence where ageing time is reduced to 20 cycles at 8 WHSV, but regeneration severity is increased to 1450° F.

Each of the aged catalysts was MAT tested using Feedstock 2, having those properties as listed in Table VI. Results of the Catalytic evaluations are presented in Table VII. Vanadium and nickel levels are cited for each catalyst and are close to the target value. Under both sets of conditions, Catalyst 7, the unprotected catalyst, is substantially deactivated, with respect to Catalyst 8 containing the vanadium trap. Under test C1, Catalyst 8 is approximately 30% more active, and shows a significant gain in gasoline yield, coupled with a simultaneous improvement (i.e., reduction) in hydrogen and coke selectivity. Under the milder conditions of test C2, Catalyst 8 is still 16% more active than the reference with similar directional improvements in yield pattern. Reduction of vanadium's dehydrogenation activity is still apparent, albeit less extensive because deposited vanadium has less opportunity to migrate and poison the catalyst. Thus, the effectiveness of the instant dolomite/sepiolite additives for enhanced specificity for vanadium, even in the presence of nickel, has been demonstrated.

TABLE I

| Catalyst: 2 Average Vanadium Content, ppm | | |
|---|---|---|
| Particle: | OCTACAT | Additive B |
| Fresh | 280 | 40 |
| Steamed: | 200 | 390 |
| Gain (Loss) | (80) | 350 |
| Ratio: V Steamed/V Fresh | 0.71 | 9.8 |

TABLE II

| Gas Oil Inspections | |
|---|---|
| Stock Identification | Feedstock No. 1 |
| Inspections: | |
| Gravity | 27.4 |
| Nitrogen, wt % | 0.10 |
| Basic Nitrogen, ppm | 244 |
| Pour Point | 33 |
| Aniline Point, °F. | 187.3 |
| Distillation, D 1160 Dist. | |
| Start | 444° F. |
| 10 Pct. Cond. | 607° F. |
| 30 pct. Cond. | 707° F. |
| 50 Pct. Cond. | 784° F. |
| 70 Pct. Cond. | 867° F. |
| 90 Pct. Cond. | 979° F. |
| EP | 1046° F. |

TABLE III

| Catalyst | 1A | 1C | 3A | 3C | 4A | 4C |
|---|---|---|---|---|---|---|
| Additive B, wt % | — | — | — | — | 20 | 20 |
| Vanadium, ppm | 0 | 0 | 6000 | 6000 | 6000 | 6000 |
| Steaming, hrs. | 0 | 72 | 0 | 72 | 0 | 72 |
| Zeolite unit cell size, Å | 24.26 | 24.25 | 24.25 | 24.25 | 24.25 | 24.25 |
| Conversion, wt % | 70 | 64 | 59 | 54 | 63 | 59 |
| Activity | 2.33 | 6.77 | 1.43 | 1.17 | 1.70 | 1.43 |
| Yield, wt % | | | | | | |
| C5-430 | 50 | 47 | 44 | 40 | 47 | 45 |
| H2 | 0.076 | 0.127 | 0.389 | 0.495 | 0.149 | 0.233 |
| Coke | 2.96 | 2.51 | 0.176 | 2.08 | 2.64 | 2.62 |

TABLE IV

| Catalyst | 3A | 5A | 3B | 5B | 3C | 5C |
|---|---|---|---|---|---|---|
| Vanadium, ppm Nominal | | | ← 6000 → | | | |
| Fresh Additive, % | — | 10 | — | 10 | — | 10 |
| Steaming, hrs. | 0 | 0 | 48 | 48 | 72 | 72 |
| Conversion, wt % | 59 | 55 | 54 | 54 | 54 | 54 |
| Activity | 1.43 | 1.22 | 1.17 | 1.17 | 1.17 | 1.17 |
| Yield, wt % | | | | | | |
| C5-430 | 44 | 42 | 41 | 40 | 40 | 41 |
| H2 | 0.389 | 0.334 | 0.564 | 0.382 | 0.495 | 0.350 |
| Coke | 1.76 | 2.13 | 2.05 | 1.69 | 2.08 | 1.51 |
| Selectivity* | | | | | | |
| C5-430 | 0.75 | 0.76 | 0.76 | 0.74 | 0.74 | 0.76 |
| H2 | 0.0066 | 0.0061 | 0.0104 | 0.0071 | 0.0092 | 0.0065 |
| Coke | 0.0298 | 0.0387 | 0.0380 | 0.0313 | 0.0385 | 0.0280 |
| Vanadium Additive/Vanadium FCC | | 0.10 | | 5.7 | | 6.8 |

*Yield per unit conversion

TABLE V

| Catalyst: | 4A | 6A | 4B | 6B | 4C | 6C |
|---|---|---|---|---|---|---|
| Fresh Additive A | 0 | 10 | 0 | 10 | 0 | 10 |
| Steaming hrs. | 0 | 0 | 48 | 48 | 72 | 72 |
| Conversion, wt % | 63 | 61 | 60 | 58 | 59 | 59 |
| Activity | 1.70 | 1.56 | 1.50 | 1.38 | 1.43 | 1.43 |
| Yield, wt % | | | | | | |
| C5-430 | 47 | 46 | 45 | 44 | 45 | 44 |
| H2 | 0.149 | 0.151 | 0.264 | 0.164 | 0.233 | 0.133 |
| Coke | 2.64 | 3.18 | 2.77 | 2.35 | 2.62 | 2.24 |
| Selectivity:* | | | | | | |
| C5-430 | 0.75 | 0.75 | 0.75 | 0.76 | 0.76 | 0.75 |
| H2 | 0.0024 | 0.0025 | 0.0044 | 0.0028 | 0.0039 | 0.0023 |
| Coke | 0.0419 | 0.0521 | 0.0461 | 0.0405 | 0.0444 | 0.0380 |
| Vanadium Additive/ Vanadium FCC | | 7.7 | | 15.8 | | 17.4 |

*Yield per unit conversion

TABLE VI

| Gas Oil Inspections | |
|---|---|
| Stock Identification | Feedstock No. 2 |
| Inspections: | |
| Gravity | 24.3 |
| Nitrogen, Wt % | 0.10 |
| Basic Nitrogen, ppm | 210 |
| Sulfur, Wt % | 0.33 |
| RAM Carbon | 0.17 |
| Aniline Point, °F. | 185.8 |
| Distillation, D 1160 Dist. | |
| 10 Pct. Cond. | 703° F. |
| 30 Pct. Cond. | 795° F. |
| 50 Pct. Cond. | 872° F. |
| 70 Pct. Cond. | 961° F. |
| 90 Pct. Cond. | 1098° F. |
| EP | 1256° F. |

TABLE VII

| Catalyst | 7 | 8 | 7 | 8 |
|---|---|---|---|---|
| Test | C1 | C1 | C2 | C2 |
| Vanadium, ppm | 4700 | 3770 | 3990 | 4260 |
| Nickel, ppm | 2700 | 2200 | 2360 | 2340 |
| Conversion, wt % | 58 | 65 | 59 | 63 |
| Activity | 1.37 | 1.81 | 1.44 | 1.67 |
| Yield, wt % | | | | |
| C5-430 | 42 | 47 | 43 | 46 |
| H2 | 0.97 | 0.76 | 0.98 | 0.92 |
| Coke | 5.83 | 5.61 | 6.02 | 6.26 |
| Selectivity* | | | | |
| C5-430 | 0.74 | 0.73 | 0.73 | 0.72 |
| H2 | 0.0169 | 0.0117 | 0.0166 | 0.0143 |
| Coke | 0.1012 | 0.0871 | 0.1022 | 0.0969 |

*Yield per unit of conversion

What is claimed is:

1. A process for the removal of vanadium metallic contamination from a vanadium-contaminated FCC particulate catalyst containing crystalline alumina silicate zeolite and metal contaminants in an amount of 2,000 ppm to 10,000 ppm expressed in terms of vanadium based on the weight of the catalyst, comprises the steps of:

Downloading said contaminated catalyst from an FCC regenerator;

Charging said downloaded contaminated catalyst to an external reactor containing 10% to 40% by weight based on catalyst of separate distinct additive particles;

Contacting said cotaminated catalyst and said additive particles in said external reactor under reaction conditions comprising 1200° F.-1400° F. temperature in the presence of steam;

wherein said additive particles comprise:

(a) A first component which is a magnesium-containing material comprising a hydrous magnesium silicate;

(b) A second component which is a calcium-containing material selected from the group consisting of dolomite, calcium magnesium silicate, calcium magnesium oxide, calcium magnesium acetate, calcium magnesium carbonate, and calcium magnesium subcarbonate;

(c) A binder selected from the group consisting of kaolin, bentonite, montmorillonite, saponite, hectorite, alumina, silica, titania, zirconia, silica-alumina, and combinations thereof;

wherein the weight ratio of material (a) to material (b) is from about 80:20 to about 20:80 and said binder comprises about 5 to 30% by weight of said additive particle based on the total weight of said additive particle; and separating an FCC particulate catalyst of reduced vanadium content.

2. The process of claim 1 wherein said calcium-containing material comprises dolomite.

3. The process of claim 1 wherein said magnesium-containing material comprises material selected from the group consisting of sepiolite, attapulgite, polygorskite, saponite, talc and amorphous synthetic magnesium silicate.

4. The process of claim 1 wherein said hydrous magnesium silicate comprises sepiolite.

5. The process of claim 1 wherein said hydrous magnesium silicate comprises Spanish sepiolite.

6. The process of claim 1 wherein said hydrous magnesium silicate comprises attapulgite.

7. The process of claim 1 wherein said calcium-containing material has a particle size of about 3 microns or less.

8. The process of claim 1 wherein the weight ratio of material (b) to material (a) is from 50:50 to about 70:30.

9. The process of claim 1 wherein said catalyst comprises a zeolite.

10. The process of claim 1 wherein said catalyst comprises a zeolite selected from the group consisting of faujasite, ultra-stable Y, rare-earth exchanged Y, and dealuminated Y.

11. The process of claim 1 wherein said catalyst comprises a zeolite selected from the group consisting of ZSM-5, silicalite, borolite and betazeolite.

12. The process of claims 9, 10, and 11 wherein said zeolite is rare-earth exchanged.

13. The process of claims 9, 10, and 11 wherein said zeolite is ammonium exchanged.

14. The process of claims 9, 10, and 11 wherein said zeolite is dispersed in refractory oxide matrix.

15. A process according to claim 1 wherein said additive particles are further comprised of an antimony or bismuth compound.

16. A process according to claim 15 wherein said antimony or bismuth compounds are selected from the group consisting of antimony oxide or bismuth oxide.

17. A process according to claim 16 wherein said compound is bismuth oxide.

18. A process according to claim 1 wherein said FCC particulate catalyst of reduced vanadium content is separated from said additive by a process particle size differentiation or magnetic separation.

* * * * *